US005682987A

United States Patent [19]

Herzog

[11] Patent Number: 5,682,987

[45] Date of Patent: Nov. 4, 1997

[54] WATCH BOX WITH IMPROVED WATCH BEZEL HOLDER

[76] Inventor: Jack Herzog, 5702 Durocher Street, Montreal, Canada, H2V 3Y2

[21] Appl. No.: 630,457

[22] Filed: Apr. 10, 1996

[51] Int. Cl.[6] ..... B65D 85/40

[52] U.S. Cl. ..... 206/301; 206/316.1; 206/425; 206/445; 206/477

[58] Field of Search ..... 206/301, 425, 206/477, 478, 476, 316.1, 445

[56] References Cited

U.S. PATENT DOCUMENTS

| | | | |
|---|---|---|---|
| 620,984 | 3/1899 | Smith | 206/316.1 X |
| 860,264 | 7/1907 | Stevens | 206/316.1 X |
| 2,487,302 | 11/1949 | Bradley | 206/477 X |
| 2,747,787 | 5/1956 | Davidson, Jr. | 206/445 |
| 4,105,115 | 8/1978 | Horrath et al. | 206/370 |
| 4,848,574 | 7/1989 | Murphy et al. | 206/425 X |
| 5,169,001 | 12/1992 | Scheibel | 206/425 |

*Primary Examiner*—Byron P. Gehman
*Attorney, Agent, or Firm*—Pollock Vande Sande & Priddy

[57] ABSTRACT

A watch box includes a base, and a watch bezel holder comprising a plurality of louvered slats on the base. Each slot has a first edge and a second edge that is opposite to the first edge. The first edge of each slat contacts the base and each slat is disposed to form a predetermined acute angle between the slat and the base. Adjacent slats are separated forming a slot between the slats for holding a watch bezel. Another embodiment uses a boustrophedonic member to form the slots for holding bezels.

2 Claims, 2 Drawing Sheets

WATCH BOX WITH IMPROVED WATCH BEZEL HOLDER

BACKGROUND OF THE INVENTION

1. Field of Invention

The present invention relates to a watch box adapted to support a watch for purposes of display and having a watch bezel holder for supporting and displaying a plurality interchangeable bezels for the watch.

2. Description of the Related Art

FIG. 1 shows a prior art watch box 10 adapted to support a watch 11 and having two conventional watch bezel holders 12. Watch box 10 can be any of a plurality of different shapes and sizes that are suitable for holding a watch 11. FIG. 4 shows a cross-sectional view of watch box 10 and one of the conventional watch bezel holders 12 shown in FIG. 1 taken along line 4—4. Conventional bezel holder 12 is formed on a base 13 of the watch box and comprises a boustrophedonic member 14 having slots for storing interchangeable watch bezels. Member 14 has a plurality of trough portions 15, a corresponding plurality of peak portions 16 and a plurality of surface portions 17. Each surface portion 17 extends between a trough portion 15 and an adjacent peak portion 16. The trough portions 15 are in proximity to base 13. Each respective surface portion substantially forms a right angle between the surface portion and base 13. Each surface portion 17 is separated from an adjacent surface portion to form a plurality of slots 18 between the adjacent surface portions. Boustrophedonic member 14 may be formed from a material, such as, for example, a stiff felt-type material, having sufficient rigidity and resilience for slots 18 to hold a watch bezel 19. A material 20, such as a foam rubber material, for example, can be used between base 13 and member 14 for providing support for member 14 for holding watch bezels in slots 18. FIG. 4 shows a watch bezel **19*a* that is aligned for insertion into a slot 18 and a bezel 19*b*** that is held in place in a slot.

Conventional bezel holder 12 suffers from the problem that watch bezels being stored in a slot must be viewed on-edge so that any decorative marking on a bezel is hidden from view. Consequently, watch bezels that appear to be similar when viewed on-edge need to be removed from holder 12 when a bezel selection is being made. Further, watch bezels having a diameter that is less than the depth of a slot can become completely hidden from view by being fully inserted into a slot.

SUMMARY OF THE INVENTION

The present invention provides a watch box of the type shown in FIG. 1 having an improved bezel holder that so holds bezels that decorative markings on the bezels are not hidden from view and the bezels do not need to be removed from the holder in order to be viewed. Additionally, the improved watch bezel holder avoids the situation where small diameter watch bezels may become completely hidden from view by the holder. In that regard, the watch box of the present invention provides a watch bezel holder on a base portion of the box comprising a plurality of louvered slats each of which has a first edge and a second edge that is opposite to the first edge. The first edge of each slat contacts the base and the slat is disposed to form a predetermined acute angle between the slat and the base. Adjacent slats in said plurality of slats are separated to form a slot for holding a watch bezel. Preferably, the first edge and the second edge of each slat are separated by a predetermined distance allowing a portion of each held watch bezel to be viewed without removal from the bezel holder.

Another embodiment of the present invention provides a watch box having a base on which a watch can be supported for purposes of display and a watch bezel holder on said base formed by a boustrophedonic member. The boustrophedonic member has a plurality of trough portions, a plurality of peak portions and a plurality of surface portions such that each surface portion extends between a trough portion and an adjacent peak portion. The trough portions of the boustrophedonic member are in proximity to the base with the peak portions being opposite to the trough portions. Each surface portion is disposed to substantially form an acute angle between the surface portion and the base. Each surface portion is separated from an adjacent surface portion to form a plurality of slots for holding a plurality of watch bezels. Preferably, each surface portion is substantially the same length between a peak portion and an adjacent trough portion allowing a portion of each held watch bezel to be viewed without removal from the holder.

BRIEF DESCRIPTION OF THE DRAWINGS

The present invention is illustrated by way of example and not limitation in the accompanying figures in which like reference numerals indicate similar elements and in which.

DETAILED DESCRIPTION OF THE PREFERRED EMBODIMENTS

Figure 1:
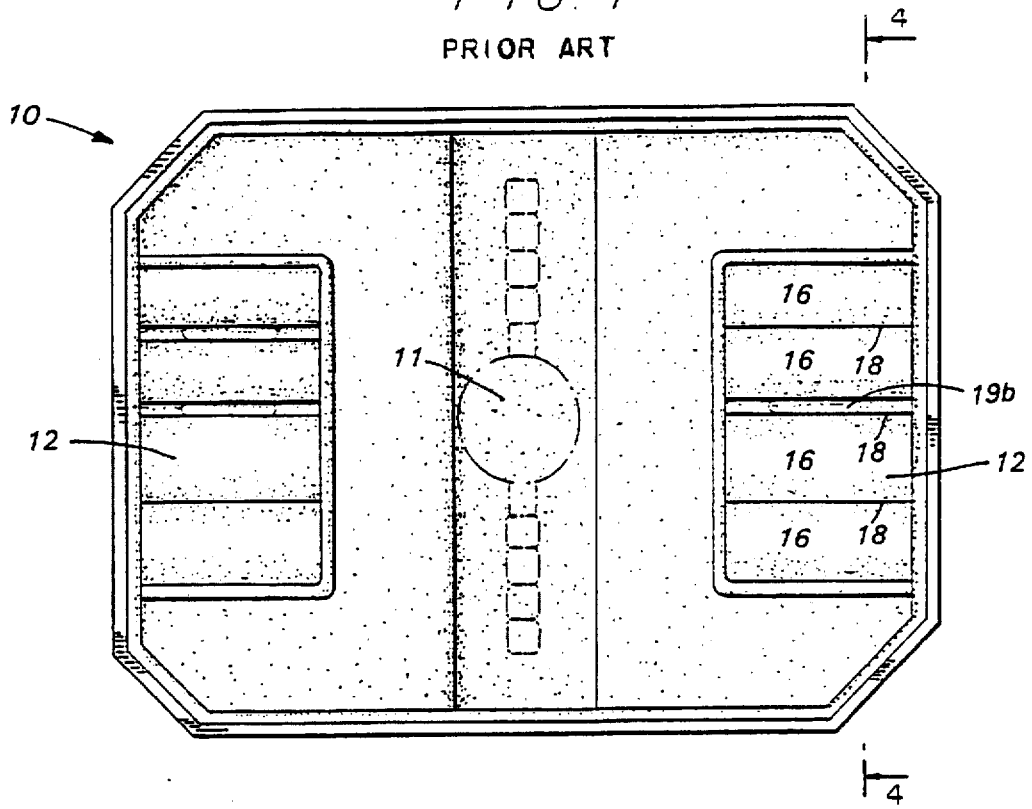
FIG. 1 PRIOR ART
FIG. 1 shows a prior art watch box having a conventional watch bezel holder.
Figure 2:
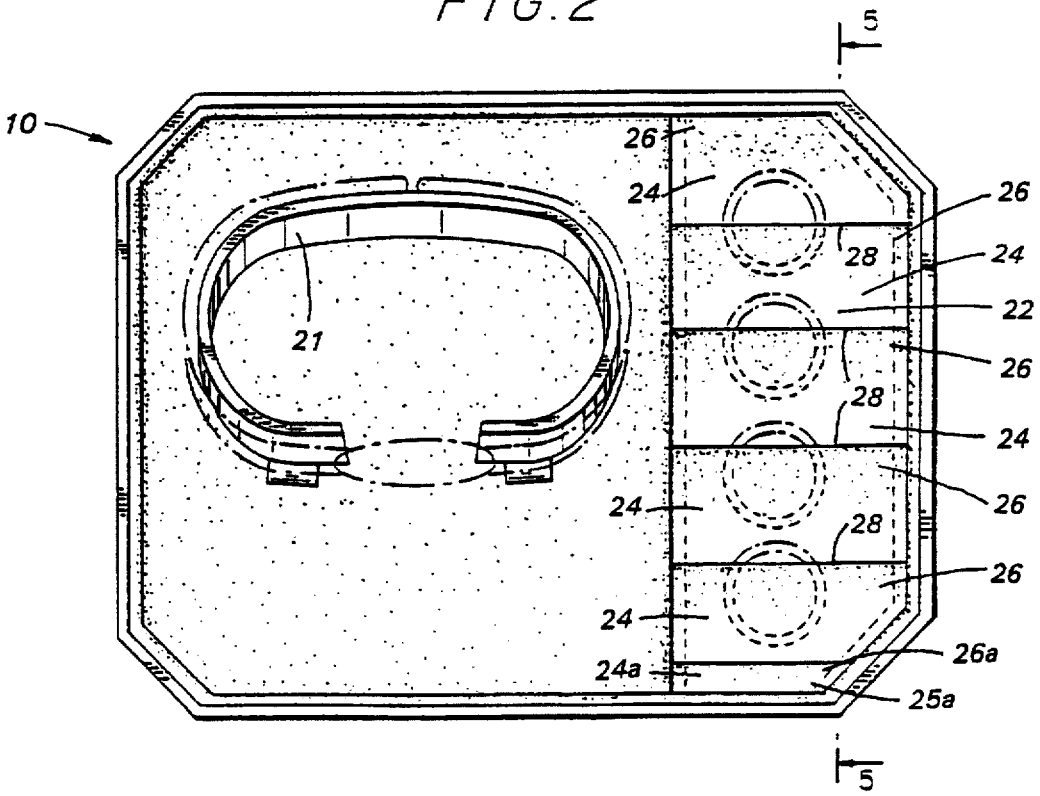
FIG. 2 shows a first embodiment of a watch box having an improved watch bezel holder according to the present invention.
Figure 5:
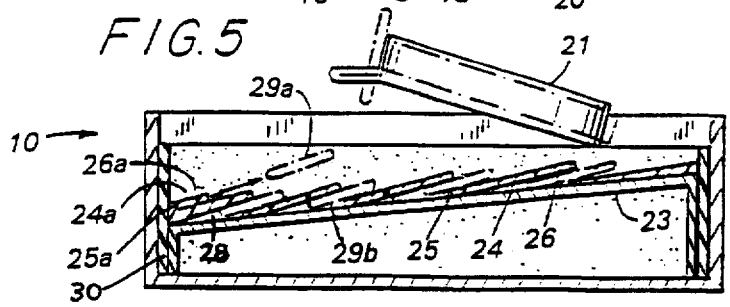
FIG. 5 shows a cross-sectional view of the first embodiment of the present invention shown in FIG. 2 taken along line 5—5.

FIG. 2 shows a first embodiment of the watch box of the present invention an improved watch bezel holder 22. Like the watch holder of FIG. 1, watch box 10 of FIG. 2 can be any of a plurality of different shapes and sizes that are suitable for holding a watch on watch frame 21. FIG. 5 shows a cross-sectional view of watch bezel holder 22 shown in FIG. 2 taken along line 5—5. Watch bezel holder 22 is disposed on a base 23 of the watch box and has a plurality of louvered slats 24. Each slat has a first edge 25 and a second edge 26, that is opposite to the first edge 25, and with the first edge 25 in proximity to base 23. Each slat 24 forms a predetermined acute angle between the slat and base 23. Slats 24 are separated from each other and positioned along base 23 to form a plurality of slots 27 that are each capable of holding a watch bezel. The height of the slat, that is, the distance between first edge 25 and second edge 26 of each slat, and the angle formed by the slats with base 23 are selected to allow a portion of the bezels stored in the holder to be viewed without removal from holder 22, as shown in FIG. 2. Slat **24*a*, because of its proximity to a side wall 30 of the watch box, has a first edge 25*a* that is adjacent to sidewall 30. The distance between first edge 25*a* and second edge 26 of slat 24*a* is chosen so that a portion of a bezel stored in a slot behind slat 24***a* is visible. Slats 24 can be made from any suitable material, such as a cardboard-type material, for example, that provides sufficient rigidity and resilience for holding bezels. FIG. 5 shows a watch bezel 29*a* that is aligned for insertion into a slot 28 and a bezel 29*b* that is held in place in a slot.

Figure 3:
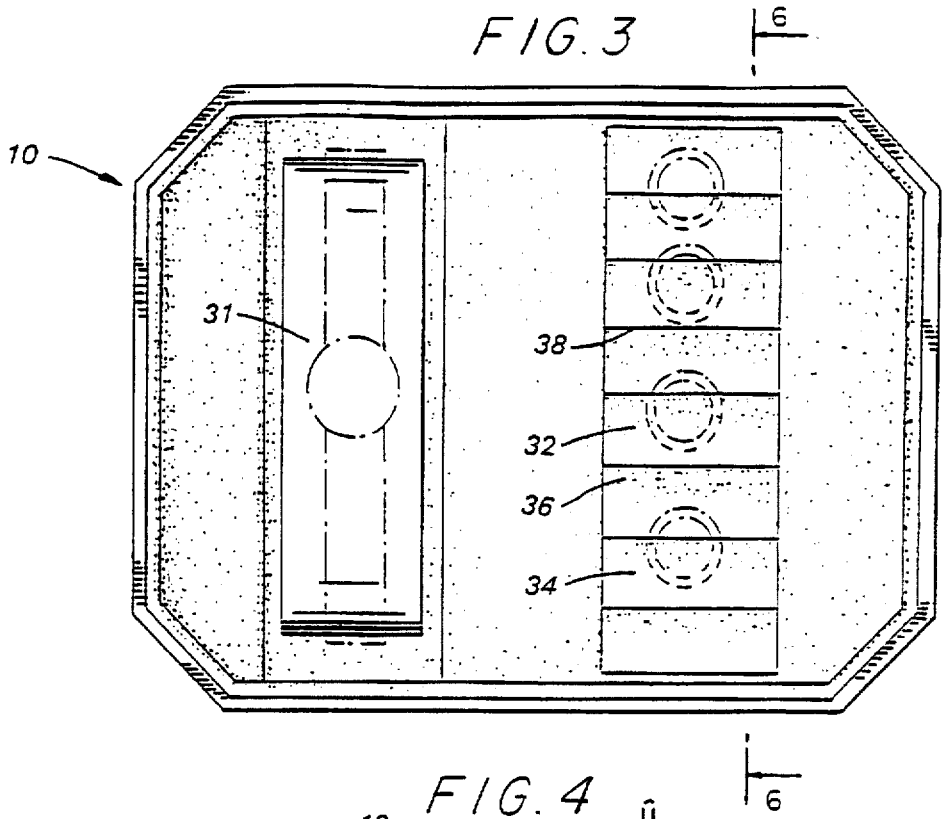
FIG. 3 shows a second embodiment of a watch box having an improved watch bezel holder according to the present invention.
Figure 4:
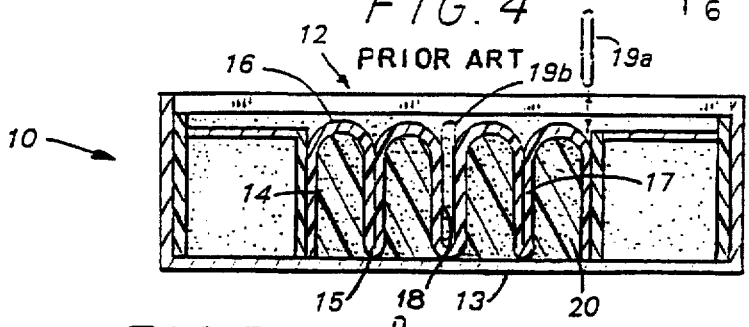
FIG. 4 shows a cross-sectional view of the conventional watch bezel holder of FIG. 1 taken along line 4—4.
Figure 6:
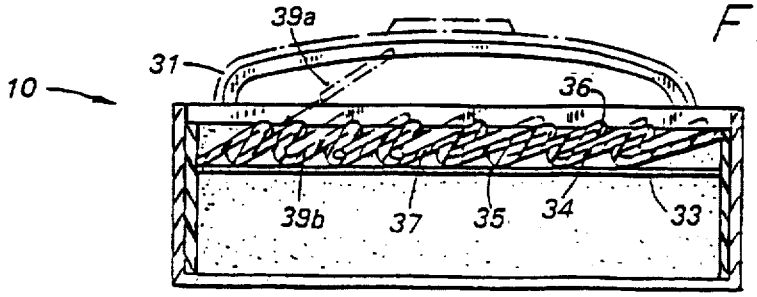
FIG. 6 shows a cross-sectional view of the second embodiment of the present invention shown in FIG. 3 taken along line 6—6.

FIG. 3 shows a second embodiment of the watch box of the present invention having an improved watch bezel holder 32 different in construction from the bezel holder of the first embodiment. Watch box 10 of FIG. 3 can be any of a plurality of different shapes and sizes that are suitable for holding a watch on watch frame 31. FIG. 6 shows a cross-sectional view of watch bezel holder 32 shown in FIG. 3 taken along line 6—6. Watch bezel holder 32 includes a boustrophedonic member 34 mounted on base 33 of the watch box. Member 34 has a plurality of trough portions 35, a corresponding plurality of peak portions 36 and a plurality of surface portions 37 extending between a trough portion and an adjacent peak portion. The trough portions 35 are in proximity to base 33, while the peak portions 36 are opposite to the trough portions 35. As shown in FIG. 6, each surface portion 37 is oriented at an acute angle to base 33, and is separated from an adjacent surface portion to form a plurality of slots 38 between adjacent surface portions. Each slot 38 between adjacent surface portions is capable of holding a watch bezel 39. The depth of each slot 38, that is, the distance between a trough portion 35 and an adjacent peak portion 36, and the angle formed by the surface portions with base 33 are selected to allow a portion of the bezels being stored to be viewed without removal from holder 32, as shown in FIG. 3. Preferably, each surface portion 37 is substantially a same length between a peak portion 35 and an adjacent trough portion 36. Member 34 can be made from any suitable material, such as stiff felt-type material, for example, that provides sufficient rigidity, resilience and durability for holding bezels. FIG. 6 shows a watch bezel 39*a* that is aligned for insertion into a slot 38 and a bezel 39*b* that is held in place in a slot.

While the present invention has been described in connection with the illustrated embodiments, it will be appreciated and understood that modifications may be made without departing from the true spirit and scope of the invention.

What is claimed is:

1. In a watch box of the type comprising a base, support means for supporting a watch on said base, and a watch bezel holder disposed on said base adjacent said support means for holding a plurality of bezels that can be interchangeably mounted on the watch, the improvement wherein said watch bezel holder comprises a plurality of louvered slats disposed in spaced overlying relation to one another, each of said slats having a first edge and a second edge that is opposite to the first edge, the first edge of each slat contacting said base, each slat being oriented at a predetermined acute angle relative to the base, and the second edge of each slat being separated by a predetermined distance from the first edge of an underlying adjacent slat to form a slot between the adjacent slats for holding a watch bezel.

2. In a watch box of the type comprising a base, support means for supporting a watch on said base, and a watch bezel holder disposed on said base adjacent said support means for holding a plurality of bezels that can be interchangeably mounted on the watch, the improvement wherein said watch bezel holder comprises a boustrophedonic member having a plurality of trough portions, a plurality of peak portions and a plurality of surface portions which extend respectively between one of said trough portions and an adjacent peak portion, each of said trough portions being in proximity to said base and the peak portions being opposite to said trough portions, each surface portion being oriented to form a substantially acute angle between the surface portion and the base, and each surface portion being separated from an adjacent surface portion and forming a slot between adjacent surface portions for holding a watch bezel.

* * * * *